US006964365B2

(12) United States Patent
Mt.Pleasant et al.

(10) Patent No.: US 6,964,365 B2
(45) Date of Patent: Nov. 15, 2005

(54) LIBRARY CARD HOLDER

(76) Inventors: Gregory Mt.Pleasant, 406 Osceola Rd., Syracuse, NY (US) 13209; Mark T. Bower, 8940 Jackson Rd., Clay, NY (US) 13041; Marvin K. Read, 7082 Forbes Rd., Canastota, NY (US) 13032

( * ) Notice: Subject to any disclaimer, the term of this patent is extended or adjusted under 35 U.S.C. 154(b) by 0 days.

(21) Appl. No.: 10/431,478

(22) Filed: May 7, 2003

(65) Prior Publication Data

US 2004/0222275 A1 Nov. 11, 2004

(51) Int. Cl.[7] ..... B65D 27/00
(52) U.S. Cl. ..... 229/74; 229/71
(58) Field of Search ..... 229/74, 71; 383/106, 383/87; 40/768, 771–772, 775–777

(56) References Cited

U.S. PATENT DOCUMENTS 3,339,826 A * 9/1967 Beskind ..... 229/68.1
3,372,858 A 3/1968 Brody
3,424,636 A 1/1969 Brody
3,525,470 A * 8/1970 Carrigan ..... 229/74
3,592,381 A 7/1971 Brody
3,943,645 A * 3/1976 Viesturs ..... 40/661
4,549,658 A * 10/1985 Sfikas ..... 206/466
4,771,557 A * 9/1988 Bowman ..... 40/771
4,914,842 A * 4/1990 Lieberman ..... 40/773
4,958,450 A * 9/1990 Roberg ..... 40/771
5,318,324 A 6/1994 Lombardo et al.
5,427,640 A 6/1995 Daniels
6,129,387 A 10/2000 Chess
6,692,806 B2 * 2/2004 Woods ..... 428/40.1

* cited by examiner

*Primary Examiner*—Jes F. Pascua
(74) *Attorney, Agent, or Firm*—Robert J. Sinnema; Bond, Schoeneck & King, PLLC

(57) ABSTRACT

A pocket for holding media is disclosed, comprising two sheets of clear archival material fused on three sides to form a pocket and including attachment means, such as a coating of adhesive, to attach the holder to a book or other media.

8 Claims, 1 Drawing Sheet

Fig. 1
*(PRIOR ART)*
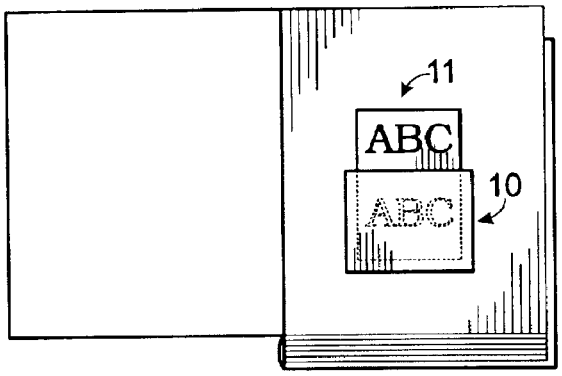
Fig. 2
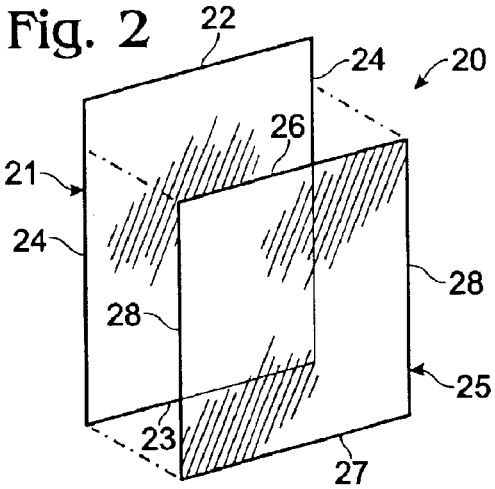
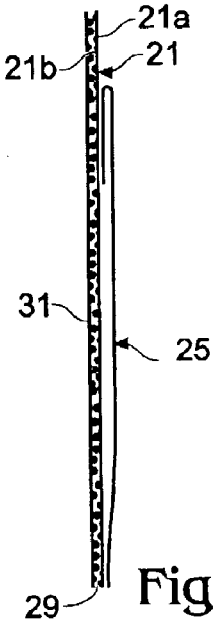
Fig. 3B
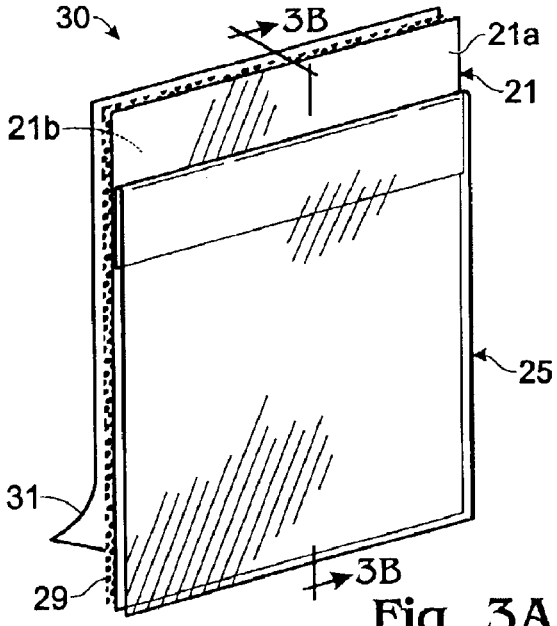
Fig. 3A

LIBRARY CARD HOLDER

FIELD OF THE INVENTION

This invention relates to media which are cataloged, for example by a library, and therefore require a pocket to hold a card containing cataloging information. For example, books, tapes and compact discs lent out by libraries typically contain a pocket in which a card can be maintained with cataloging information such as the book or disc's due date.

BACKGROUND OF THE INVENTION

Prior art pockets, such as those disclosed in U.S. Pat. No. 6,129,387 to Chess and U.S. Pat. No. 5,318,324 to Lombardo, are made of paper or paper-like material. As a result, one cannot see through the pocket to view information that is recorded on the card or, if no card is in the pocket, one cannot see through the pocket to view information or images recorded on the surface to which the card is attached. In the case of music compact disks, a great deal of information is typically visible on the compact disc case, some or all of which would be obscured by an opaque pocket.

Further, such pockets experience substantial stress at the corners where the front panel and rear panel join, mostly from insertion and removal of the cataloging card. The prior art methods of reinforcing stress points on such a pocket include using heavier paper stock or folding the paper at a stress point to create a double sheet. In either case, the reinforcement causes the paper pocket to become thicker and more bulky.

In addition, the pockets disclosed in Chess and Lombardo require preparation and folding before they are ready for use in a book or on other media. Specifically, such pockets require selective removal of strips to expose adhesive, folding the intermediates into a suitable pocket shape and applying the formed pocket to the book or other media. The folding of such pockets increases the bulk of the pockets, causing them to fit poorly in some books. In addition, the necessity of folding and preparing the pockets for use makes them inconvenient to use.

Other prior art pockets, such as those disclosed in U.S. Pat. Nos. 3,592,381 and 3,372,858, both to Brody, adhere to the book or other media over only a portion of their back surface and use the media surface to form one portion of the pocket. As a result, such pockets are not securely attached to the book or other media. In addition, because the adhesive that is used to form the sides of such a pocket is also the adhesive that attaches the pocket to the book, it is possible for a card contained in such a pocket to contact the adhesive, thereby marring the card and weakening the adhesive.

What is needed is a pocket that is made of clear, archival material and that is thin, durable and easily mounted to a wide variety of cataloged media.

SUMMARY OF THE INVENTION

It is an object of the present invention to provide a pocket for cataloging various media that is made of clear material.

It is a further object of the present invention to provide a pocket for cataloging various media that is made of archival material.

It is yet another object of the present invention to provide a pocket for cataloging various media that is thin and durable.

Finally, it is another object of the present invention to provide a pocket that is easily mounted to a wide variety of cataloged media.

These and other objectives are accomplished by a pocket formed from two sheets of clear, archival material, such as sheets of polypropylene. Such a pocket comprises two sheets of such material, substantially similar in size and shape, except that preferably, the top sheet is shorter in its vertical dimension than the bottom sheet. The two sheets are fused together along their coextensive bottom edges and the co-extensive portion of their side edges, preferably using sonic welding techniques. The bottom sheet has on its back surface a coating of adhesive, preferably temporarily repositionable adhesive. Finally, the adhesive is covered by a releasable sheet of coated paper or similar material that allows the pocket to be handled without exposing the adhesive. Prior to affixing the pocket to the book or other media, the releasable sheet is removed to expose the adhesive and is then discarded.

BRIEF DESCRIPTION OF THE DRAWINGS

FIG. 1 is a view of a typical prior art pocket.

FIG. 2 is an exploded view of one embodiment of the present invention.

FIG. 3A is an oblique view of the preferred embodiment of the present invention.

FIG. 3B is an exploded side view of the preferred embodiment of the present invention.

DETAILED DESCRIPTION OF THE INVENTION

Shown at FIG. 1 is a typical pocket 10 used to store a cataloging card 11 in a book or on other media in a library or similar institution. Such a pocket 10 is typically placed on an inner surface of a book or on an exterior surface of a compact disc case, record album or other media case. A typical pocket 10 is made of paper and is therefore opaque. If there is indicia or an image on the surface to which the card 11 is attached, the indicia or image is obscured when the pocket 10 is placed over it. Further, also as shown at FIG. 1, indicia on the lower portion of the card 11 are obscured by the lower front portion of the pocket 10, one must remove the card 11 from the pocket 10 to view data on the lower part of the card, or to confirm that no data has been entered on the lower part of the card.

A pocket 20 according to the present invention is comprised of a first sheet of clear material 21 and a second sheet of clear material 25. In the preferred embodiment, the sheets 21 and 25 are made of polypropylene, preferably 2.5 mils in thickness; however, polypropylene in the range of 2 to 5 mils is acceptable. Polypropylene is the preferred material for the sheets. Polypropylene is archival, meaning that it is stable and non-acidic and, as a result, it does not cause the deterioration of paper or other materials with which it comes in contact. Polypropylene is also clear and, unlike vinyl, does not become yellow as it ages. In addition to polypropylene, other clear, archival and non-yellowing plastic materials are also acceptable.

In the preferred embodiment, the sheets 21 and 25 are substantially rectangular in shape. Each sheet 21 and 25 has a top edge 22, 26, a bottom edge 23, 27 and two side edges 24, 28. However, the size and shape of the sheets 21 and 25 can be adapted depending on the needs of a particular application. For example, to hold a library card dimensioned 3" by 5", rectangular sheets of approximately 3.5" by 5.25" would be desirable.

Preferably, the first sheet bottom edge 23 and the second sheet bottom edge 27 are the same length and are positioned such that they are co-extensive along their entire respective lengths. In the preferred embodiment, the side edges 28 of the second sheet 25 are approximately 80% of the length of the side edges 24 of the first sheet 22. The side edges 28 of the second sheet 25 are co-extensive along their entire length with the side edges 24 of the first sheet 21. The first sheet top edge 22 is the same length as the second sheet top edge 26. The first sheet top edge 22 is parallel to the second sheet top edge 26, but the respective top edges 22 and 26 are not co-extensive.

The first sheet 21 has a front surface 21*a* and a back surface 21*b*. The back surface 21*b* has means for attaching the pocket to the book or other media. In the preferred embodiment, the attachment means is adhesive 29 to allow the pocket 20 to be affixed to a book or other media. Other means such as static attraction, mechanical attachment, such as by stapling, or cohesive may be substituted for adhesive. The adhesive 29 may be permanent or repositionable. In the preferred embodiment the adhesive 29 is a temporarily repositionable adhesive, such that the pocket 20 can be repositioned for only approximately 5 minutes after it is first affixed to the book or other media. The adhesive 29 may cover some or all of the back surface 21*b*. As is known to those skilled in the art, the amount of adhesive 29 must be sufficient to securely attach the pocket 20 to a book or other media. In the preferred embodiment, the adhesive 29 covers all of the back surface 21*b*. A covering 30 comprised of coated paper or similar material known to those skilled in the art is co-extensive with the back surface 21*b* of the first sheet 21 and is releasably secured by the adhesive 29 to the back surface 21*b* of the first sheet 21. Prior to affixing the pocket 20 to a book or other media, the covering 30 is removed to expose the adhesive 29. The covering 30 is disposable and, as is known to those skilled in the art, the covering may be perforated or cut to make it more easily removable.

In the preferred embodiment, the top edge 26 of the second sheet 25 is folded in toward the front surface 21 a of the first sheet 21, as seen in FIG. 4, a side view of the preferred embodiment. In this embodiment, the second sheet 25 is approximately 90% of the length of the first sheet 21, and the portion of the second sheet 25 that is folded over is approximately 10% of the length of the second sheet 25. Folding over the top edge 26 of the second sheet 25 increases the durability of the pocket 20.

The first sheet bottom edge 23 and second sheet bottom edge 27 are fused together. In addition, the second sheet side edges 28 are fused to the first sheet side edges 24. Preferably, the edges are fused together using ultrasonic welding; however, other acceptable techniques will be known by those skilled in the art.

What is claimed is:

1. A pocket, comprising:

a first sheet of clear material having a top edge, a bottom edge, two side edges, a front surface and a back surface;

a second sheet of clear material having a top edge, a bottom edge, two side edges, a front surface and a back surface;

attachment means on said first sheet's back surface;

wherein said second sheet's bottom edge is coextensive with and fused to said first sheet's bottom edge and each of said second sheet's side edges is partially coextensive with and fused to said first sheet's respective side edges, such that a pocket is formed between said first sheet's front surface and said second sheet's back surface; and wherein said second sheet's top edge is partially folded down along said second sheet's back surface.

2. The device of claim 1 wherein said attachment means comprises repositionable adhesive.

3. The device of claim 2 further comprising a removable and disposable covering coextensive with said adhesive coating.

4. The device of claim 1 wherein said first and second sheets of clear material are polypropylene.

5. The device of claim 1 wherein said first and second sheets of clear material are comprised of archival material.

6. The device of claim 1 wherein said first sheet and said second sheet are fused together using ultrasonic welding.

7. The device of claim 1, wherein said second sheet's side edges are shorter than said first sheet's side edges.

8. A pocket, comprising:

a first sheet of clear material having a top edge, a bottom edge, two side edges, a front surface and a back surface;

a second sheet of clear material having a top edge, a bottom edge, two side edges, a front surface and a back surface;

attachment means on said first sheet's back surface;

wherein said second sheet's bottom edge is coextensive with and fused to said first sheet's bottom edge and each of said second sheet's side edges is partially coextensive with and fused to said first sheet's respective side edges, such that a pocket is formed between said first sheet's front surface and said second sheet's back surface; and wherein said second sheet's side edges are shorter than said first sheet's side edges.

* * * * *